US010472774B2

(12) United States Patent
Campman

(10) Patent No.: US 10,472,774 B2
(45) Date of Patent: Nov. 12, 2019

(54) RAILROAD BRACKET

(71) Applicant: Robert A. Campman, Greenville, PA (US)

(72) Inventor: Robert A. Campman, Greenville, PA (US)

(73) Assignee: GRACE INDUSTRIES, INC., Fredonia, PA (US)

( * ) Notice: Subject to any disclaimer, the term of this patent is extended or adjusted under 35 U.S.C. 154(b) by 334 days.

(21) Appl. No.: 14/960,350

(22) Filed: Dec. 5, 2015

(65) Prior Publication Data

US 2017/0159243 A1 Jun. 8, 2017

(51) Int. Cl.
*E01B 26/00* (2006.01)
*B61L 23/06* (2006.01)

(52) U.S. Cl.
CPC ..... *E01B 26/00* (2013.01); *B61L 23/06* (2013.01)

(58) Field of Classification Search
CPC ..... E01B 26/00; B61L 23/06
USPC ..... 238/338–343
See application file for complete search history.

(56) References Cited

U.S. PATENT DOCUMENTS 713,404 A * 11/1902 Copeland et al. ..... E01B 5/16 238/288
787,003 A * 4/1905 Seitz ..... E01B 3/16 238/285
1,218,425 A * 3/1917 Lindstrom ..... E01B 5/16 238/339
1,250,117 A * 12/1917 Hansen ..... E01B 3/16 238/338
1,553,128 A * 9/1925 Barnett ..... E01B 23/04 238/10 R
8,061,662 B1 * 11/2011 Bartek ..... B61L 3/04 246/203 D
2002/0060195 A1 * 5/2002 Humphrey ..... E01B 7/24 211/13.1
2012/0257195 A1 * 10/2012 Scherf ..... B61K 9/08 356/237.1

* cited by examiner

*Primary Examiner* — Zachary L Kuhfuss
(74) *Attorney, Agent, or Firm* — Daniel K. Dorsey

(57) ABSTRACT

The non-ferrous anticorrosive railroad bracket 10 includes a stainless steel threaded shaft 50 for preventing oxidation on moving parts. A sliding clamp plate mechanism 36 is for mounting to virtually any common rail 54 in use throughout the world. The bracket 10 includes a pointed wedge end 14 for providing under-rail installation by displacing stone gravel base underneath. It also includes a tool-less clamping rail attachment mechanism 32 requiring only hand-tighten for installation. There is a large knob-nut 34 for tightening and securing to the rail 54 by easily hand-tightening. A simple folded kick-plate 12 is utilized for kicking by foot, pushing by hand, and hammering so as to easily displace gravel, stones, slag, and other material. Lastly, the folded kick-plate 12 acts as a handle to carry the bracket 10 and an attached sensor detector unit 30.

6 Claims, 3 Drawing Sheets

RAILROAD BRACKET

BACKGROUND OF THE INVENTION

1. Field of the Invention

The present invention relates to a tool-less lockable railroad bracket with a built-in kick plate and other gravel or stone displacing qualities for easy placement.

2. Description of the Related Art

Background: Aside from transporting freight and passengers, the railroad industry has several ancillary track support activities performed daily primarily dealing with track maintenance and inspection tasks. On a daily basis, the tasks have to be carried out by maintenance personnel. The daily tasks insure the performance integrity of the tracks, and thereby also ensuring the safety of the railroad tracks, its workers and passengers.

As part of maintaining the rail system there are several crews of track workers performing repair and maintenance activities every day all year around. As the rail system has become more sophisticated and busy, the necessity for maintenance personnel has increased significantly. This results in many more track workers, maintenance and inspection personnel in harms way of being struck by a passing train or other track-maintenance vehicle.

Methods and protocols are in place with railroads and their maintenance contractors to help prevent active rail traffic from occurring during the same time period as the track workers and maintenance workers are present. Unfortunately, even though these methods and protocols are in place, there remain many commonly occurring scenarios where active trains and maintenance equipment can rapidly enter a work or inspection zone without the knowledge or expectation of the personnel actively working on the track. This immediate danger of trains or rail track vehicles entering work zones has caused many recorded injuries and fatalities. In fact, this serious problem to prevent injuries and fatalities has not just been recent occurrence or even just over the past several decades, but since the beginning of the railroads. Accordingly, a need exists to warn of trains or rail track vehicles entering work zones to prevent injuries and fatalities.

SUMMARY OF THE INVENTION

There are few, if any safety products currently available that are designed specifically to warn track workers or inspection personnel of oncoming rail traffic. There are, however, other personal safety alarm devices presently available that use sensors and radio technology to alert a person, or workers of impending danger regardless of its source. An example of such a product is the TPASS, which is an industry-standard motion sensing man-down alarm device that is capable transmitting or receiving various signals by radio, indicating an emergency condition, such as evacuate or distress alarm, regardless if this condition was initiated by a remote sensor device or the worker themselves. The TPASS has been available for over 15 years and the device is widely used by industry and fire fighters as their best, last defense against a dangerous scenario where a 'may-day' or panic alarm signal must be sent.

The present invention as illustrated applies a mature, widely used technology and product line, the TPASS, to provide an early warning alerting system for these track workers and inspection personnel to provide advanced warming of an oncoming train or track vehicle. Further to this, a sensor mounting bracket was invented to easily attach to a rail, typically as part of a railroad track, to facilitate implementation of the track worker safety system.

The railroad bracket is a universal rail bracket that easily attaches to a rail, typically the railroad track used by trains, locomotives, railcars or any other hi-rail vehicle. A hi-rail vehicle being defined as any other maintenance or inspection vehicle aside from a locomotive or railcar that rides on the rails of the track. The railroad bracket was initially designed as part of a larger track-watch rail worker safety system for mounting a sensor-detector device to the rail for detecting the presence of a passing rail car, locomotive or other hi-rail vehicle including maintenance vehicles. Thus, the railroad bracket contains several unique features, which are valuable to the railroad industry.

The railroad bracket is a rapidly installed device that attaches to a rail, typically a rail that is part of a railroad track and is designed to accommodate sensing or other signaling, detection or counting devices that can be used.

Accordingly, it is a principle object of the invention to be adjustable, sliding clamp plate mechanism for providing a sizing for mounting to virtually any common rail size in use throughout the world.

Another object of the invention is to have a pointed wedge end that provides under-rail installation by easily displacing the stone gravel base underneath the rail.

A further object of the invention is to ensure the railroad bracket is a tool-less clamping rail attachment mechanism requiring only hand-tighten for installation.

A still further object of the invention is to provide a large knob-nut for tightening and securing to a rail by easily hand-tightening.

Another object of the invention is to have the railroad bracket lockable by common and readily available padlock to prevent it from being easily removed or stolen.

A further object of the invention is to incorporate an electronic RFID (radio frequency identification) tag to uniquely identify each railroad bracket and, or placement thereof at a work zone or other assignment.

A still further object of the invention is to utilize a simple folded end kick-plate allowing kicking by foot or pushing by hand or hammer for easily displacing gravel, stones, slag or other material sliding placement of the base material.

Another object of the invention is to permit the attachment to the inside bottom of the rail.

A still further object of the invention is to permit it to be used as a handle to carry the bracket and attached sensor detector unit.

An object of the invention is to construct the railroad bracket to be made by using steel, or other non-ferrous or anticorrosive metals.

Another object of the invention is to compose the railroad bracket with a stainless steel threaded shaft for preventing oxidation to occur on threaded moving parts.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
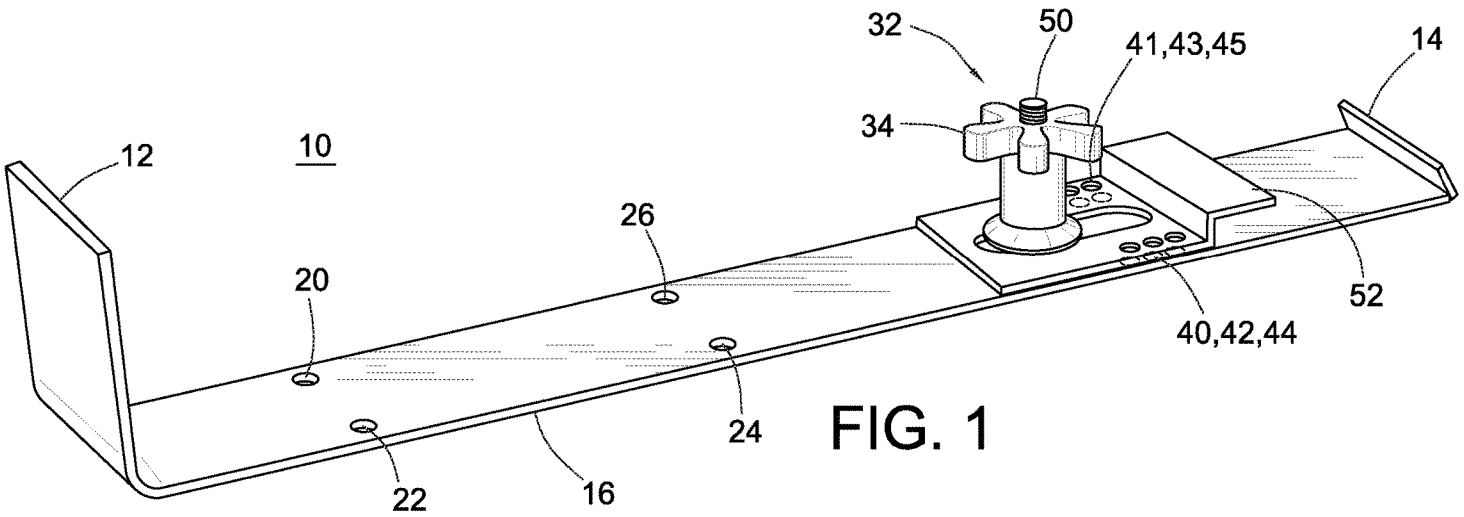
FIG. 1 is an environmental, perspective view of a railroad bracket according to the present invention.
Figure 2:
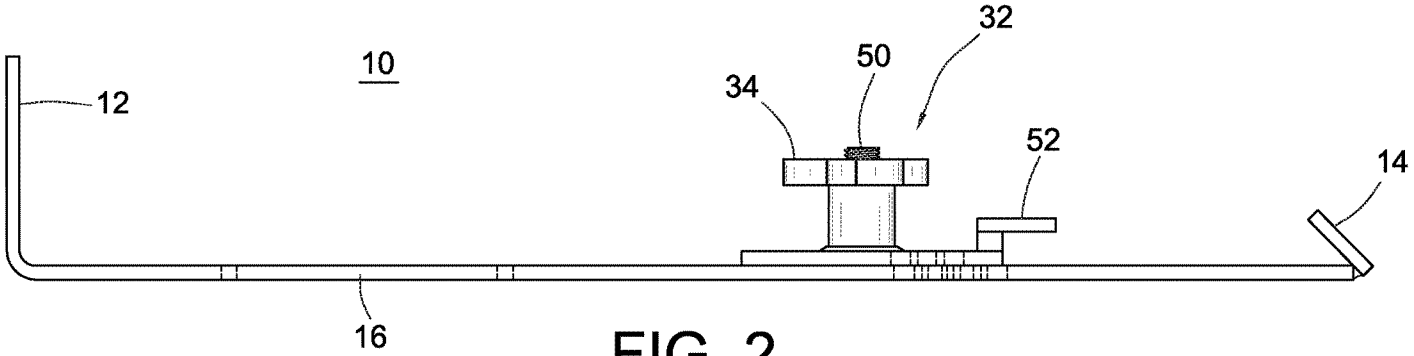
FIG. 2 is a side view of a railroad bracket according to the present invention.

With reference to each of the FIGS. 1, 2, 3, 4, and 5, a railroad bracket according to the present invention is illustrated and is generally indicated by the numeral 10. The railroad bracket 10 is non-ferrous anticorrosive material and includes a perpendicular end forming a folded kick plate and handle 12. At the other end of the railroad bracket 10 is pointed wedge end 14. The flat bar 16 between the two ends 12 and 14 includes a number of mounting holes 20, 22, 24, and 26. These mounting holes 20, 22, 24, 26 receive a Sensor Detection Unit, generally indicated by the numeral 30 and illustrated specifically as a box in FIGS. 3, 4, and 5.

It is contemplated the Sensor Detection Unit 30 could be for example a product such as a TPASS, which is an industry-standard motion sensing ma down alarm device. The TPASS is capable transmitting or receiving various signals by radio, indicating an emergency condition, such as evacuate or distress alarm, regardless if this condition was initiated by a remote sensor device or the worker themselves. The TPASS has been available for over 15 years and the device is widely used by industry and fire fighters as their best, last defense against a dangerous scenario where a 'may-day' or panic alarm signal must be sent.

Figure 3:
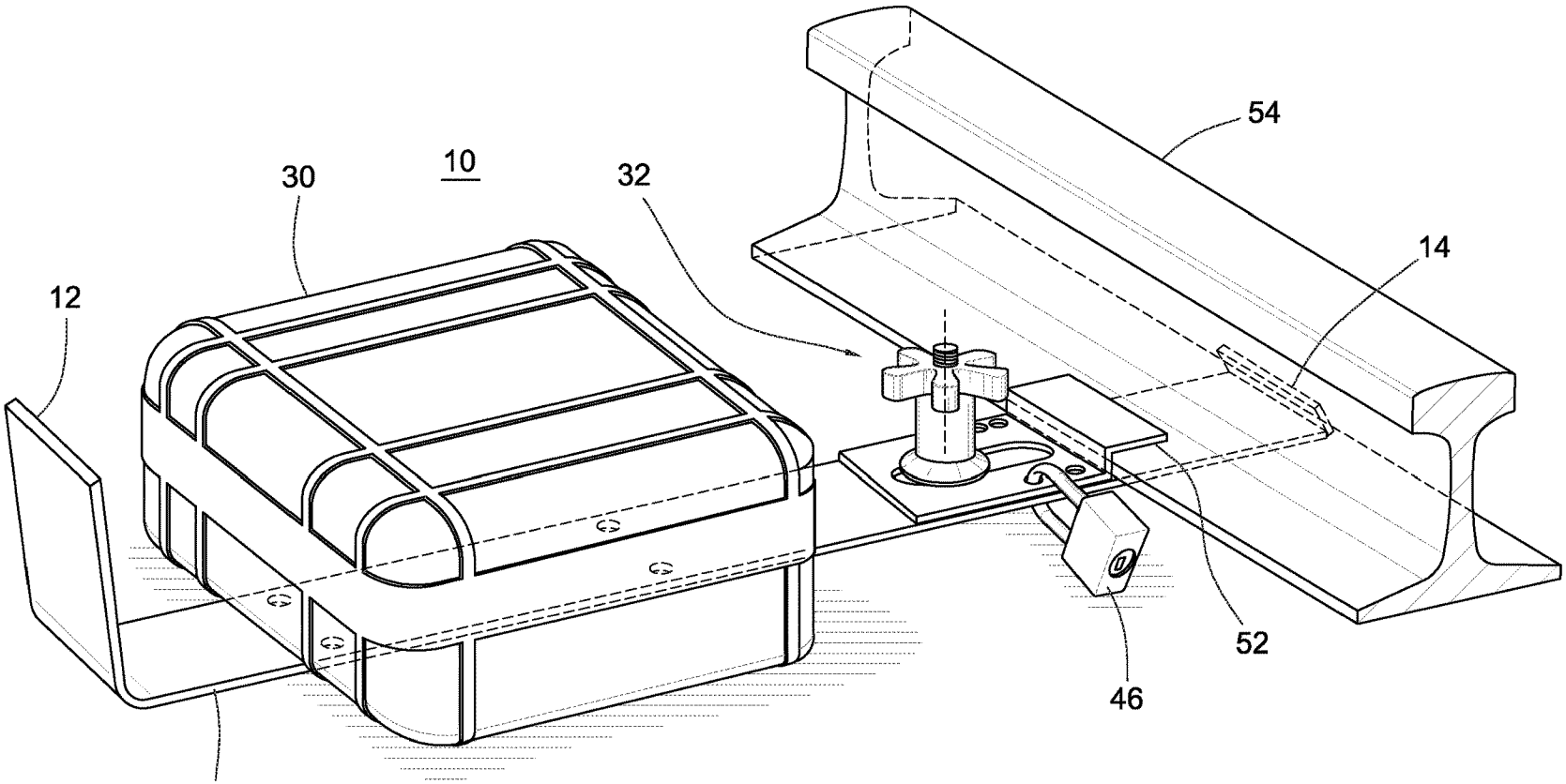
FIG. 3 is an environmental, perspective view of the railroad bracket with a sensor detection unit mounted thereon and the bracket being securely attached to a rail according to the present invention.
Figure 4:
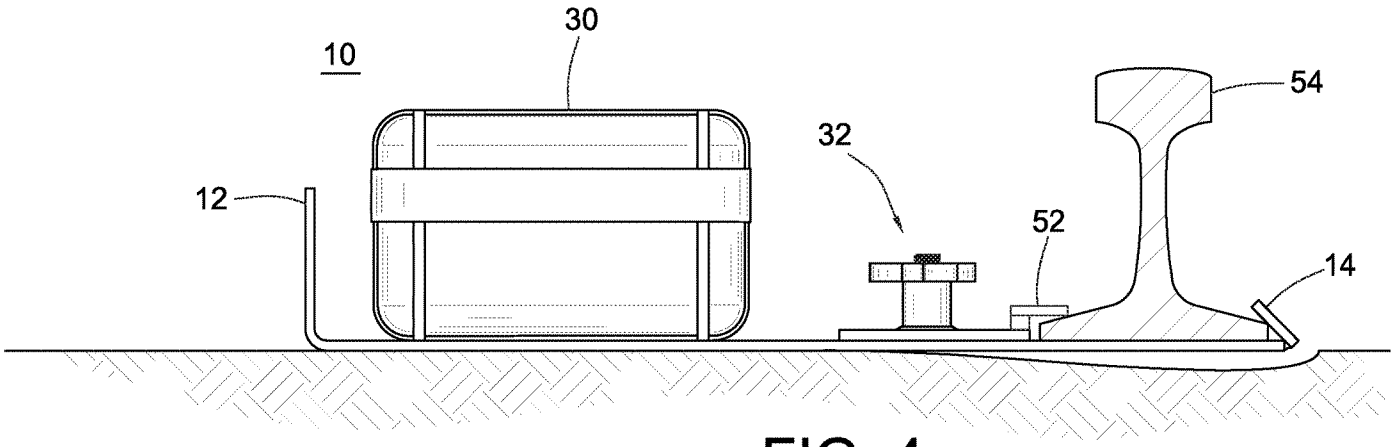
FIG. 4 is an environmental side view of the railroad bracket according to the present invention.

The pointed wedge end 14 provides under-rail installation by displacing stone gravel base underneath. Near the pointed wedge end 14 is an adjustable tool-less clamping rail attachment or mechanism, generally indicated by the numeral 32. The mechanism 32 includes a knob nut 34 for securing in place a sliding clamp plate 36. The tool-less clamping rail attachment mechanism 32 requires only hand-tighten for installation. The large knob-nut 34 provides the ease to hand-tightening. The sliding clamp plate 36 includes a number of fitting holes 40, 42, 44 and 41, 43, 45 are located on either side of the knob nut 34. Each of these holes can be align with any of the similar formed holes on the flat bar 16. These fitting or aligning holes receive a padlock 46, as illustrated in FIG. 3. The knob nut 34 is received on a stainless steal threaded shaft 50. Part of the tool-less clamping rail mechanism 32 includes a raised lip 52, which extends toward the pointed wedge end 14. These two members 14 and 52 when functioning together will secure the railroad bracket 10 on a rail 54, as illustrated in FIGS. 3, 4, and 5.

In fact, the railroad bracket 10 is a universal rail bracket that easily attaches to the rail 54, typically the railroad track used by trains, locomotives, railcars or any other hi-rail vehicle. A hi-rail vehicle being defined as any other maintenance or inspection vehicle aside from a locomotive or railcar that rides on the rails of the track. The railroad bracket 10 was initially designed as part of a larger track-watch rail worker safety system for mounting a sensor-detector device to the rail for detecting the presence of a passing rail car, locomotive or other hi-rail vehicle including maintenance vehicles. Thus, the railroad bracket contains several unique features, which are valuable to the railroad industry.

Figure 5:
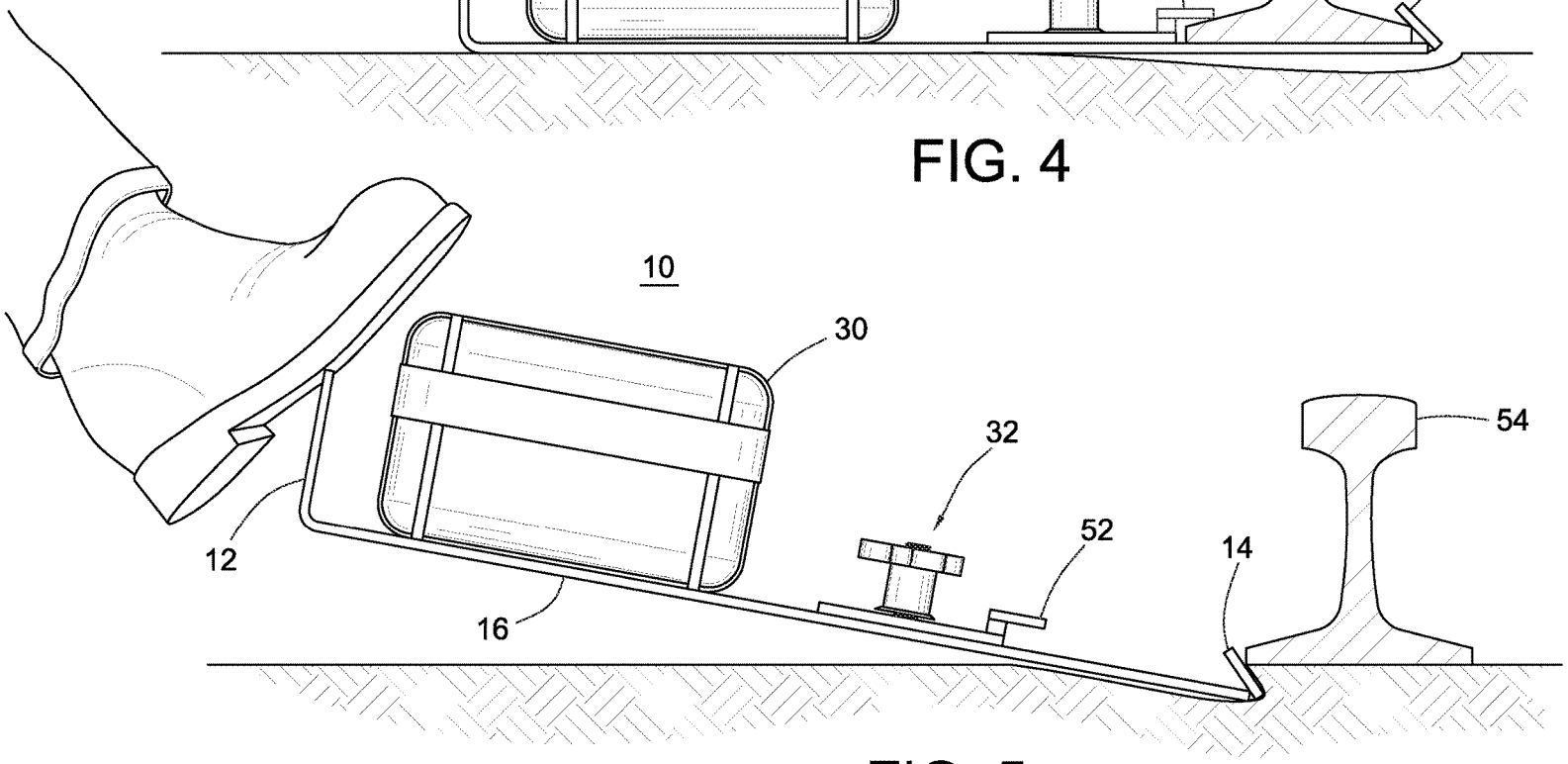
FIG. 5 is an environmental side view of the railroad bracket being manually installed by foot according to the present invention.

As shown in FIG. 5, the railroad bracket 10 is a rapidly installed device that attaches to a rail 54 and is designed to accommodate sensing or other signaling, detection or counting devices that can be used. The simple folded kick-plate 12 is utilized for kicking by foot, pushing by hand, and hammering so as to easily displace gravel, stones, slag, and other material.

It is to be understood that the present invention is not limited to the embodiment described above, but encompasses any and all embodiments within the scope of the following claims.

I claim:

1. A railroad bracket, comprising:

an adjustable, sliding clamp plate mechanism for mounting to a rail having a common rail size;

a pointed wedge end for providing under-rail installation by displacing stone gravel base underneath the rail;

a tool-less clamping rail attachment mechanism requiring only hand-tighten for installation;

means for preventing said railroad bracket from being easily removed by providing a lockable padlock attachable to said railroad bracket;

an electronic RFID (radio frequency identification) tag to uniquely identify each railroad bracket and placement thereof; and a nearly folded end kick-plate for permitting kicking by foot, pushing by hand, and hammering to displace gravel, stones, slag and other material while sliding into place said railroad bracket.

2. The railroad bracket of claim 1, comprising:

a large knob-nut for tightening and securing to the rail by easily hand-tightening.

3. The railroad bracket of claim 1, further comprising means permitting the attachment to fit an inside bottom part of the rail.

4. The railroad bracket of claim 3, wherein the attachment includes a handle to carry the bracket and attached sensor detector unit.

5. The railroad bracket of claim 1, wherein the railroad bracket being constructed of non-ferrous and anticorrosive metals, such as steel.

6. The railroad bracket of claim 1, wherein the railroad bracket being constructed with a stainless steel threaded shaft for preventing oxidation on threaded moving parts of said tool-less clamping rail attachment mechanism.

* * * * *